US005214854A

United States Patent [19]

Mennicken

[11] Patent Number: 5,214,854

[45] Date of Patent: Jun. 1, 1993

[54] SPRING-BIASED NIPPER

[75] Inventor: Jerry Mennicken, Westlake Village, Calif.

[73] Assignee: Mehaz International, Inc., Thousand Oaks, Calif.

[21] Appl. No.: 860,041

[22] Filed: Mar. 30, 1992

[51] Int. Cl.[5] ..... B26B 17/00; B26B 13/00

[52] U.S. Cl. ..... 30/186; 30/261

[58] Field of Search ..... 30/186, 187, 191, 193, 30/208, 244, 261, 262; 81/484, 489, 485

[56] References Cited

U.S. PATENT DOCUMENTS

| | | | |
|---|---|---|---|
| 1,056,084 | 3/1913 | Bates | 81/484 |
| 1,681,746 | 8/1928 | Rauh | 30/186 |
| 1,840,358 | 1/1932 | Harvey | 30/186 |
| 2,028,558 | 1/1936 | Nietzel et al. | 30/186 |
| 2,046,642 | 7/1936 | Lynch | 30/186 |
| 3,680,212 | 8/1972 | Rozmus | 30/191 |
| 4,779,342 | 10/1988 | Kobayashi | 30/192 |
| 5,007,313 | 4/1991 | Jeromson, Jr. et al. | 81/485 |

FOREIGN PATENT DOCUMENTS

| | | | |
|---|---|---|---|
| 41387 | 8/1901 | Fed. Rep. of Germany | 30/186 |

*Primary Examiner*—Douglas D. Watts
*Assistant Examiner*—Paul M. Heyrana, Sr.
*Attorney, Agent, or Firm*—Alan T. McCollom

[57] ABSTRACT

A spring-biased nipper has a pair of handles connected for pivoting movement toward and away from each other. A helical spring has first and second cylindrical ends and a relatively wide central portion which tapers toward each end. One end of the spring is threadably received in a bore formed on an inner side of one of the handles. An unthreaded bore on the opposite handle receives the other end of the spring. The spring biases the nipper handles away from one another when a user's grasp on the handles relaxes. In a second embodiment, one end of the spring is glued into an unthreaded bore formed in one of the handles.

6 Claims, 2 Drawing Sheets

SPRING-BIASED NIPPER

BACKGROUND OF THE INVENTION

1. Field of the Invention

The present invention relates generally to spring-biased nippers and more particularly to such a nipper in which handles connected for pivoting movement are biased away from one another.

2. Description of the Related Art

Conventional nippers, such as those for cutting toe nails or cuticles, comprise a pair of handles connected for pivoting movement relative to one another. One side of the nipper cutting jaw extends beyond the pivot point on each handle so that when the handles are brought together, the jaws close and cut. Biasing means are provided between the handles to bias them apart so that after a user squeezes the handles together to cause the jaws to cut, the handles move apart when the user's grip is relaxed thus opening the cutting jaws and readying the nippers for the next cut.

One prior art nipper biasing means comprises a single leaf spring affixed to one handle and having an end which abuts the other handle. Although the spring provides biasing, the spring is relatively stiff, which causes wear as the spring moves against the handle, and also results in occasional breaking of the spring.

Another prior art biasing device comprises a pair of leaf springs each having one end affixed to opposing nipper handles with each of the other spring ends connected to each other between the handles. This also is relatively stiff and like the single leaf spring is labor intensive to assemble.

Another prior art spring for heavier nippers which may be used, e.g., to cut toe nails comprises a barrel spring. Such a spring is very expensive.

It would be desirable to have a spring for biasing nipper handles which is relatively inexpensive compared to prior art biasing devices, which is less apt to break after extended use and which is easier to assemble.

SUMMARY OF THE INVENTION

The present invention comprises a nipper having a pair of handles connected for pivoting movement toward and away from each other. Nipping jaws are operably connected to the handles for cutting responsive to handle movement. The handles are biased away from one another by a helical spring disposed therebetween. The spring has one end received in a bore formed on one handle and another end received in a bore formed on the other handle. One spring end is fixed to the wall of the bore in which it is received.

The present invention provides a nipper having handles biased away from one another which is improved over the prior art in several respects. First, it is less apt to wear and therefore more reliable after extended use. Secondly, it is easier to assemble compared to prior art nippers and is therefore less expensive to produce. Finally, the cost of the spring itself is less than the cost of prior art springs for biasing nippers thereby further reducing the cost of production.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
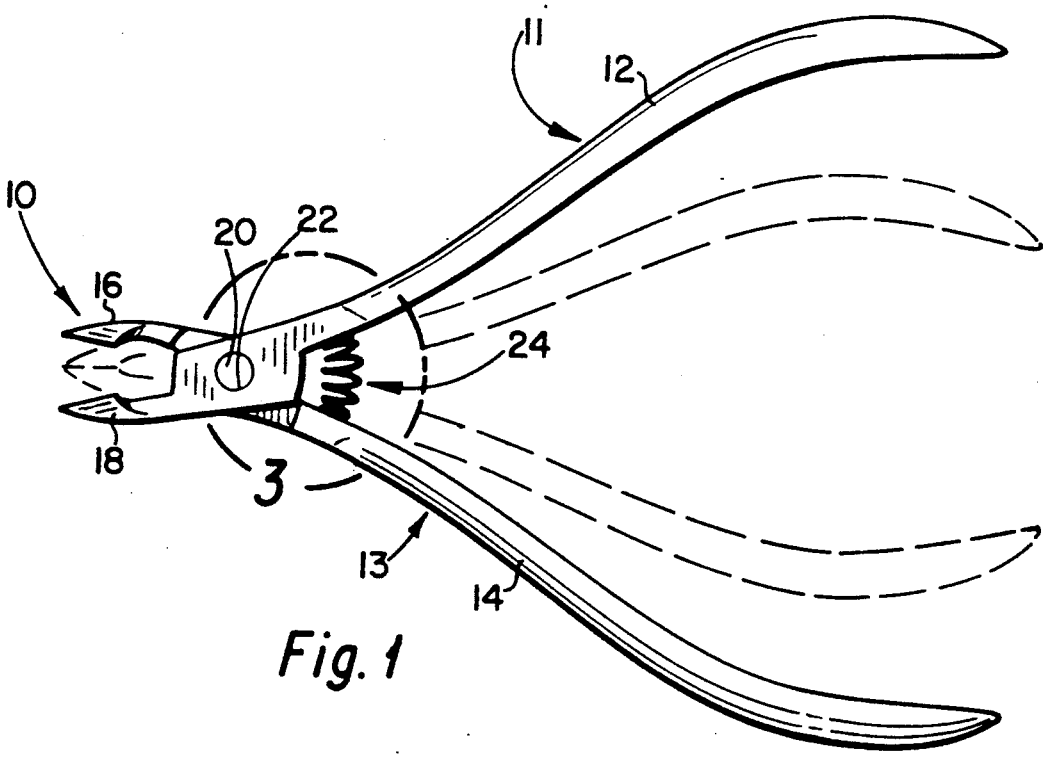
FIG. 1 is a front elevation view of a cuticle nipper constructed in accordance with the present invention with the handles biased away from one another and shown in dashed-lines with the handles moved toward one another to cause the jaws to cut.
Figure 2:
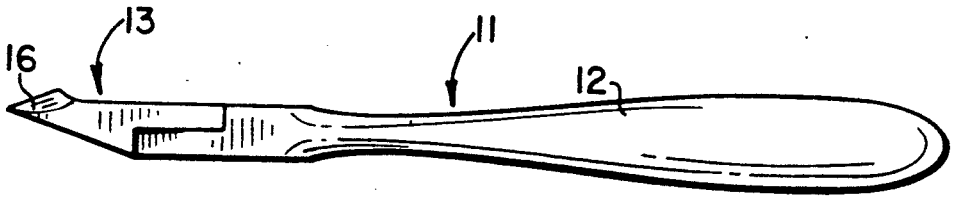
FIG. 2 is a top plan view of the nipper of FIG. 1.

Turning now to the drawing and indicated generally at 10 in FIG. 1 is a cuticle nipper constructed in accordance with the present invention. Nipper 10 includes a pair of handles 12, 14 and opposed nipping jaws 16, 18. In the present embodiment of the invention, handle 12 and jaw 18 are integrally formed from a single piece 11 of steel and handle 14 and jaw 16 are likewise integrally formed from a single piece 13.

A circular post 20 is formed integrally with piece 13 and extends through a circular bore 22 formed through piece 11. Piece 11 pivots about the axis of post 20 between a position in which the nipper jaws 16, 18 are open, as shown in the solid-line view of FIG. 1, and a position in which they are closed, shown in dashed-line configuration. Piece 11 is pivotally attached to post 20 in a known manner which prevents it from being easily removed therefrom.

Figure 3:
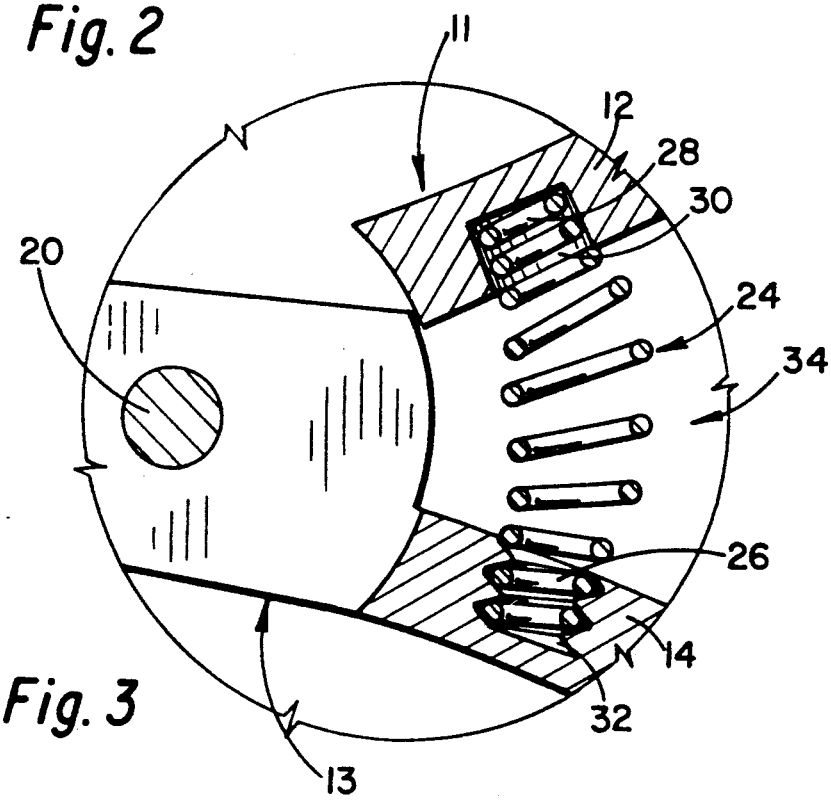
FIG. 3 is an enlarged sectional view of a portion of the nipper shown in FIG. 1.

A helical spring 24 is disposed between handles 12, 14 as shown in FIGS. 1 and 3. Spring 24 contains a first end 26 and second end 28. The ends are substantially cylindrical and are received in bores 30, 32 formed in handles 12, 14, respectively. As can be seen in FIG. 3, bore 32 has internal threads therein which are engaged with first end 26 as shown. Bore 30, however, is unthreaded and has end 28 of the spring received therein so that the end is interferingly received in bore 30. This refers to the relative sizes of spring end 30 and bore 28, i.e., spring end 30 is very slightly larger in diameter than bore 28 so that it must be forced thereinto for the spring to be received in the bore as shown in FIG. 3. When so forced, the spring is tightly received in the bore. Spring 24 is of the type known as a progressive spring due to a wide central portion, indicated generally at 34, which tapers toward both ends 26, 28.

In use, an operator grasps handles 12, 14 between the fingers and palm of one hand. Squeezing handles 12, 14 together causes piece 11 to pivot about post 20 and bring jaws 16, 18 to their closed or cutting configuration illustrated in dashed-lines in FIG. 1. When jaws 16, 18 come together as shown in FIG. 1, further pivoting stops and the cuticle is cut. Releasing pressure on handles 12, 14 permits spring 24 to expand and cause handle 12 to pivot away from handle 14 thereby opening jaws 16, 18 in preparation for the next cut.

Because of the taper in central portion 34 of the spring, the spring coils can be received one inside the other as the spring is compressed. This permits a spring with a relatively high biasing force to be compressed into a relatively small space, like the space between handles 12, 14 when jaws 16, 18 are closed.

When it becomes necessary or desirable to replace spring 24, handles 12, 14 are spread apart from the position shown in solid-lines in FIG. 1 until spring end 28 pulls from bore 30. Because spring end 26 is threadably engaged with threaded bore 32; end 28 pulls from bore 30 rather than the other end withdrawing from its associated bore. An operator then simply unscrews end 26 from bore 32 thereby removing spring 34 from the nipper. One end of a new spring (not shown) substantially identical to spring 24 is screwed into threaded bore 32 until it assumes the configuration of FIG. 3. The other end of the spring is then inserted into bore 28, also as shown in FIG. 3.

Having one end of the spring threadably secured to the nipper, prevents the spring from being launched from the nipper when the handles are pulled apart. Replacement is relatively simple. In addition, a progressive spring, like spring 24, is cheaper to manufacture and easier to install in nippers or the like than are prior art biasing devices.

Figure 4:
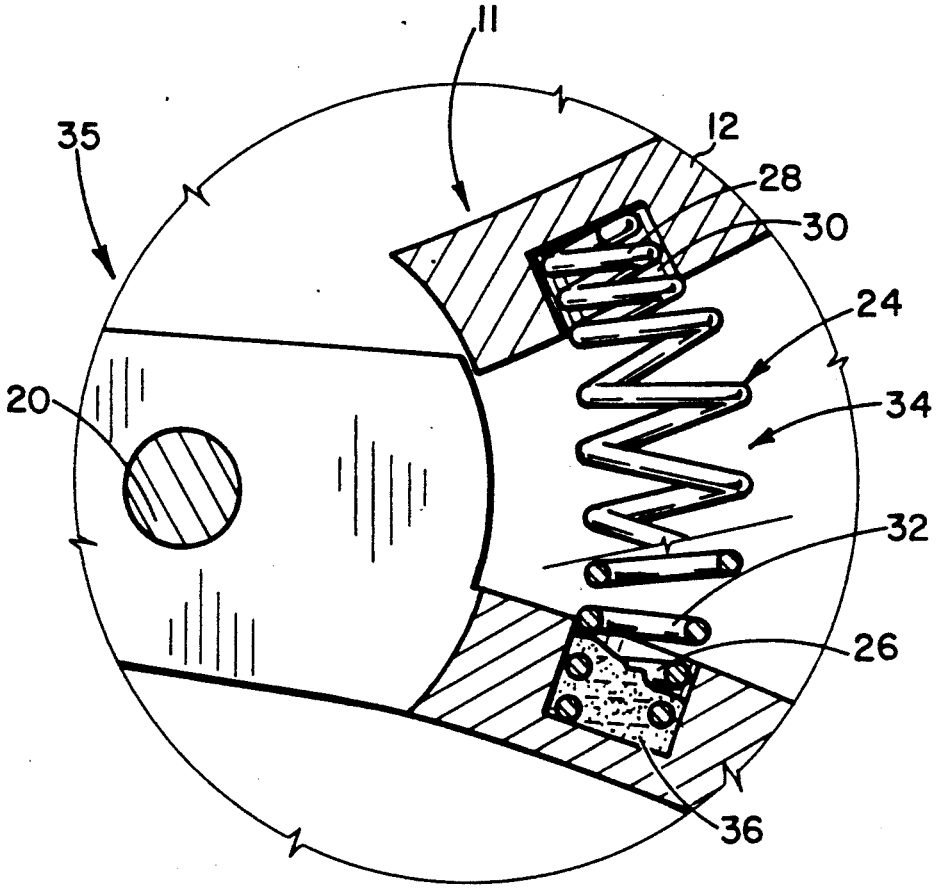
FIG. 4 is an enlarged view similar to FIG. 3 of a second embodiment of the invention.

Turning now to FIG. 4, indicated generally at 35 is an enlarged sectional view of a portion of a second cuticle nipper constructed in accordance with the present invention. Some of the numbers in FIG. 4 identify similar structure, using the same numbers, as previously identified and described in connection with FIG. 3. Unlike the embodiment of FIG. 3, bore 32 is unthreaded. After first end 26 of helical spring 24 is positioned in bore 32 as shown, commercially available glue 36 is deposited in bore 32 thus gluing spring end into the bore as shown. Thus, when the handles of the nipper are pulled apart the spring withdraws from bore 30 but remains fixed in bore 32. In the event that the spring becomes worn and/or breaks therefore requiring replacement, pliers or the like may be used to break the glue bond and pull the spring from bore 32. Another spring is then mounted on the cuticle nipper as shown.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A spring-biased nipper comprising:

a pair of handles connected for pivoting movement toward and away from each other;

nipping jaws operably connected to said handles for cutting responsive to handle movement;

a helical spring having first and second helical spring ends and being disposed between said handles along a longitudinal axis of said spring for biasing the handles away from one another;

a bore formed in each of said handles, said first spring end being received in one of said bores and said second spring end being received in the other of said bores, said second spring end and the bore in which it is received being sized relative to one another to provide an interference fit for said second spring end when it is received in said bore; and means for fixing one of said spring ends in the bore in which it is received, said fixing means comprising threads formed in one of said bores and having said first spring end threadably engaged therewith, said handles being pivotable between a first position in which said spring is compressed and said jaws are closed and a second position in which said jaws are open, said second spring end is withdrawn from its associated bore responsive to pivoting movement of said handles away from each other and said first spring end remains threadably engaged with its associated bore.

2. The nipper of claim 1 wherein said spring has a relatively wide central portion which tapers toward said spring ends.

3. The nipper of claim 2 wherein said spring ends are substantially cylindrical.

4. A spring-biased nipper comprising:

a pair of handles connected for pivoting movement toward and away from each other;

nipping jaws operably connected to said handles for cutting responsive to handle movement;

a helical spring having first and second helical spring ends and being disposed between said handles along a longitudinal axis of said spring for biasing the handles away from one another;

a bore formed in each of said handles, said first spring end being received in one of said bores and said second spring end being received in the other of said bores, said second spring end and the bore in which it is received being sized relative to one another to provide an interference fit for said second spring end when it is received in said bore; and means for fixing one of said spring ends in the bore in which it is received, said fixing means comprising glue disposed between said first spring end and the wall of the bore in which it is received, said handles being pivotable between a first position in which said spring is compressed and said jaws are closed and a second position in which said jaws are open, said second spring end is withdrawn from its associated bore responsive to pivoting movement of said handles away from each other and said first spring end remains received in its associated bore.

5. The nipper of claim 4 wherein said spring has a relatively wide central portion which tapers toward said spring ends.

6. The nipper of claim 5 wherein said spring ends are substantially cylindrical.

* * * * *